US010881198B1

(12) United States Patent
Chaoyi

(10) Patent No.: US 10,881,198 B1
(45) Date of Patent: Jan. 5, 2021

(54) SINK SHELF ORGANIZER

(71) Applicant: YOU YUN REN JIA (SHENZHEN) SERVICE CO., LTD., Shenzhen (CN)

(72) Inventor: Lin Chaoyi, Shenzhen (CN)

( * ) Notice: Subject to any disclaimer, the term of this patent is extended or adjusted under 35 U.S.C. 154(b) by 0 days.

(21) Appl. No.: 16/812,419

(22) Filed: Mar. 9, 2020

(51) Int. Cl.

| | |
|---|---|
| ***A47B 45/00*** | (2006.01) |
| ***A47B 57/06*** | (2006.01) |
| ***A47B 96/07*** | (2006.01) |
| *A47B 77/04* | (2006.01) |

(52) U.S. Cl.
CPC ..... *A47B 45/00* (2013.01); *A47B 57/06* (2013.01); *A47B 96/07* (2013.01); *A47B 77/04* (2013.01)

(58) Field of Classification Search
CPC ..... A47L 19/04; A47B 45/00; A47B 57/06; A47B 96/07; A47B 96/025; A47B 77/06
See application file for complete search history.

(56) References Cited

U.S. PATENT DOCUMENTS 204,237 A * 5/1878 Miller et al. ..... A47F 3/0404 62/246
563,467 A * 7/1896 Farwell ..... F24C 15/16 126/339
622,666 A * 4/1899 Burwell ..... E04G 1/152 182/223
779,262 A * 1/1905 Burke ..... B65D 21/086 220/8
801,275 A * 10/1905 Silk ..... B65D 21/0212 217/13
2,294,595 A * 9/1942 Dice ..... A47B 65/20 211/43
2,888,305 A * 5/1959 Perry ..... A47C 11/00 108/65
3,999,663 A * 12/1976 Walter ..... B42F 15/0094 211/175
4,286,525 A * 9/1981 Willmore ..... A47B 1/08 108/102
4,423,529 A * 1/1984 Drach ..... A47L 19/04 4/637
4,553,523 A * 11/1985 Stohrer, Jr. ..... A47J 37/0694 126/152 B
4,713,949 A * 12/1987 Wilcox ..... A47B 45/00 108/102

(Continued)

FOREIGN PATENT DOCUMENTS

DE 202019104782 U1 * 12/2019 ..... A47B 45/00
FR 2932874 A1 * 12/2009 ..... E04F 19/005
WO WO-2007148961 A1 * 12/2007 ..... A47C 11/00

*Primary Examiner* — Stanton L Krycinski
(74) *Attorney, Agent, or Firm* — KA Filing LLC; Cynthia W. Flanigan

(57) ABSTRACT

A sink shelf organizer comprising two first connecting plates, two second connecting plates and two front support legs and two rear support legs, wherein the first connecting plates each comprises one comb structure, the second connecting plates each comprises a first comb structure for coupling with the first connecting plate and a second comb structure for coupling with the opposing second connecting plate, the first and second comb structures of the second connecting plate fixed together and substantially perpendicular to each other, the two first connecting plates and two second connecting plates are coupled together to form a telescopic U-shaped frame with two corners and two free ends.

12 Claims, 5 Drawing Sheets

(56) References Cited

U.S. PATENT DOCUMENTS

| | | | | | |
|---|---|---|---|---|---|
| 5,080,320 | A * | 1/1992 | Chieng | B41J 29/06 | 211/175 |
| D372,822 | S * | 8/1996 | O'Brien | D6/513 | |
| 6,142,321 | A * | 11/2000 | West | A47B 45/00 | 108/143 |
| 6,212,708 | B1 * | 4/2001 | Mulaw | A47J 47/20 | 4/657 |
| 6,224,128 | B1 * | 5/2001 | Mains | A47B 45/00 | 108/44 |
| D445,620 | S * | 7/2001 | West | D6/574 | |
| D455,585 | S * | 4/2002 | West | D6/705.7 | |
| 6,450,349 | B2 * | 9/2002 | Lee | B65G 11/143 | 211/175 |
| 6,491,170 | B1 * | 12/2002 | Madela | A47L 19/04 | 211/41.3 |
| 6,854,402 | B2 * | 2/2005 | DuBarry | A47B 1/08 | 108/137 |
| 7,150,364 | B2 * | 12/2006 | Jablow | A47B 45/00 | 211/153 |
| D609,500 | S * | 2/2010 | Fieldhouse | D6/678 | |
| D696,540 | S * | 12/2013 | Dart | D6/705.1 | |
| 9,010,552 | B2 * | 4/2015 | Dart | A47F 5/16 | 211/186 |
| D746,087 | S * | 12/2015 | Dart | D6/678.1 | |
| 9,220,341 | B2 * | 12/2015 | Dart | A47F 5/16 | |
| 9,642,457 | B1 * | 5/2017 | Halfen | A47F 7/143 | |
| 10,077,934 | B1 * | 9/2018 | Dizon | F25D 25/005 | |
| 10,612,828 | B1 * | 4/2020 | Engelbrect | F25D 25/02 | |
| 2004/0099617 | A1 * | 5/2004 | Elias | A47L 19/04 | 211/41.3 |
| 2008/0169737 | A1 * | 7/2008 | Shen | A47B 45/00 | 312/205 |
| 2017/0245641 | A1 * | 8/2017 | Greenwood | A47B 97/00 | |
| 2019/0098995 | A1 * | 4/2019 | Brown | A47B 61/04 | |

* cited by examiner

SINK SHELF ORGANIZER

TECHNICAL FIELD

The present application relates to the technical field of household shelves, and in particular to a sink shelf organizer.

BACKGROUND

In family life, people often need to use shelves to store daily necessities, on the one hand, the shelves help people solve the storage problem and free up more space, and on the other hand, items are neatly placed on the shelves, which is more convenient for people to quickly find what they need. The spaces such as under the sink in the kitchen and under the washbasin in the bathroom are often not fully used due to pipe blocking.

In order to solve the above-mentioned problems, a rack for the underside of the sink appears on the market, which can allow pipes to pass through, and cleaning appliances (such as detergent, shampoo, etc.) can be neatly placed on the rack. The U.S. patent Ser. No. 10/334,947B1 discloses a sink shelf, the specific structure is to suspend a flat plate under the sink, there is an opening provided in the middle of the flat plate, and a small flat plate is removably received at the opening to allow the pipe to pass through. However, this kind of rack needs to be suspended and installed under the sink, which is inconvenient for installation and removal, the size of the rack cannot be adjusted, and the application scenario is limited, which affects the user experience.

SUMMARY

The purpose of the embodiments of the present application is to provide a sink shelf organizer, which aims to solve the problems of inconvenient installation and disassembly, fixed size and poor user experience of the rack under the sink in the prior art.

One embodiment of the present application provides a sink shelf organizer, which comprises two first connecting plates, two second connecting plates and two front support legs and two rear support legs, wherein the first connecting plates each comprises one comb structure, the second connecting plates each comprises a first comb structure for coupling with the first connecting plate and a second comb structure for coupling with the opposing second connecting plate, the first and second comb structures of the second connecting plate fixed together and substantially perpendicular to each other, the two first connecting plates and two second connecting plates are coupled together to form a telescopic U-shaped frame with two corners and two free ends, the two front support legs are detachably connected to the two corners of the U-shaped frame respectively and the two rear support legs are detachably connected to the two free ends of the U-shaped frame respectively.

Further, the heights of the support legs are the same and they are all adjustable.

Further, the two free ends are formed by the two first connecting plates which are extendable along the length direction thereof so that the shelf organizer is capable of being stretched back and forth.

Further, the two second connecting plates are movable relative to each other, one second connecting plate comprises an inactive second comb structure, and the other second connecting plate comprises an active second comb structure to couple with the inactive second comb structure.

Further, the one comb structure of the first connecting plate and the first and second comb structures of the second connecting plate each comprises an array of comb fingers which are arranged in parallel with each other.

Further, the first comb structure of the second connecting plate comprises an array of sliding grooves for accommodating the array of comb fingers of the first connecting plate.

Further, the second connecting plate further comprises a rectangular bottom frame arranged on the bottom of the first comb structure, and a plurality of rectangular gaps are arranged on the bottom frame, the distance between adjacent rectangular gaps along the length direction of the first comb structure is smaller than the distance between adjacent rectangular gaps along the width direction of the first comb structure.

Further, the support leg comprises a support column and a base, the diameter of the support column is smaller than the diameter of the base so that the support column is insertable into the base, and by adjusting the height of the support column inserted into the base in a clamping manner, the height of the support leg is adjustable, one end of the support column is connected to the first connecting plate or the second connecting plate, and the other end of the support column is connected to one end of the base, the other end of the base is grounded.

Further, the front support leg has a smaller width than that of the rear support leg.

Further, the one end of the support column connected to the base is provided with a first clamping portion, and the end of the base connected with the support column is provided with a second clamping portion, the first clamping portion and the second clamping portion are clamped to limit positions respectively.

Further, the grounded end of the base has an "inverted T" cross-section.

Further, the sink shelf organizer is made of PP material.

Compared with the prior art, the embodiments of the present application have the following beneficial effects: the sink shelf organizer is simple in structure and convenient to use. The U-shaped structure is used to avoid water pipes and garbage processors under the sink; the detachable connection method is convenient for installation and the shelf organizer can be assembled without screws or other tools; when not in use, it can be disassembled and placed to occupy space less space; it can realize the left and right stretching and front and back stretching of the shelf organizer, can adapt to the space under the sink of different sizes, it has a wide range of applications, makes full use of space, improves storage efficiency and material retrieval efficiency, and makes it more convenient to use. In addition, the shelf organizer has the advantages of simple design, beautiful appearance, and high user experience.

BRIEF DESCRIPTION OF THE DRAWINGS

In order to more clearly illustrate the technical solutions in the embodiments of the present application, drawings used in the description of the embodiments will be briefly described below, obviously, the drawings in the following description are some embodiments of the present application, those of ordinary skill in the art can also obtain other drawings based on these drawings without any creative efforts.

DESCRIPTION OF THE EMBODIMENTS

The technical solution in the embodiments of the present application is clearly and completely described below with reference to the accompanying drawings in the embodiments of the present application, obviously, the described embodiments are a part of the embodiments of the present application, rather than all of the embodiments. All other embodiments obtained by those of ordinary skill in the art based on the embodiments of the present application without paying any creative efforts are within the scope of protection of the present application.

The terms, such as "first", "second", "third", "fourth", etc., in the specification, claims and the accompanying drawings of the present application are used to distinguish different objects, and are not intended to describe a specific order. Furthermore, the terms "comprise", "have" and any variations thereof are intended to cover a non-exclusive inclusion. For example, a process, method, system, product, or device that comprises a series of steps or units is not limited to the listed steps or units, but alternatively comprises steps or units that are not listed, or alternatively comprises other steps or units inherent to these processes, methods, products or devices.

References to "an embodiment" herein mean that a particular feature, structure, or characteristic described in connection with the embodiments can be included in at least one embodiment of the present application. The appearances of the phrase in various places in the specification are not necessarily referring to the same embodiments, and are not exclusive or alternative embodiments that are mutually exclusive from other embodiments. Those skilled in the art will explicitly and implicitly understand that the embodiments described herein can be combined with other embodiments.

Figure 1:
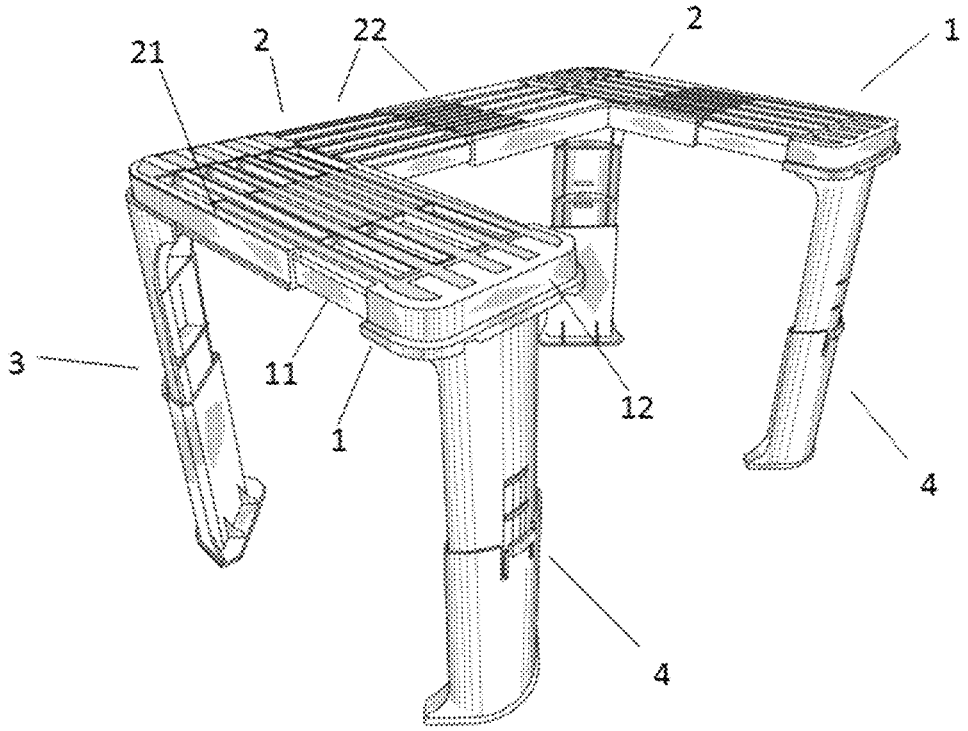
FIG. 1 is a schematic structural diagram of a sink shelf organizer provided by an embodiment of the present application.
Figure 2:
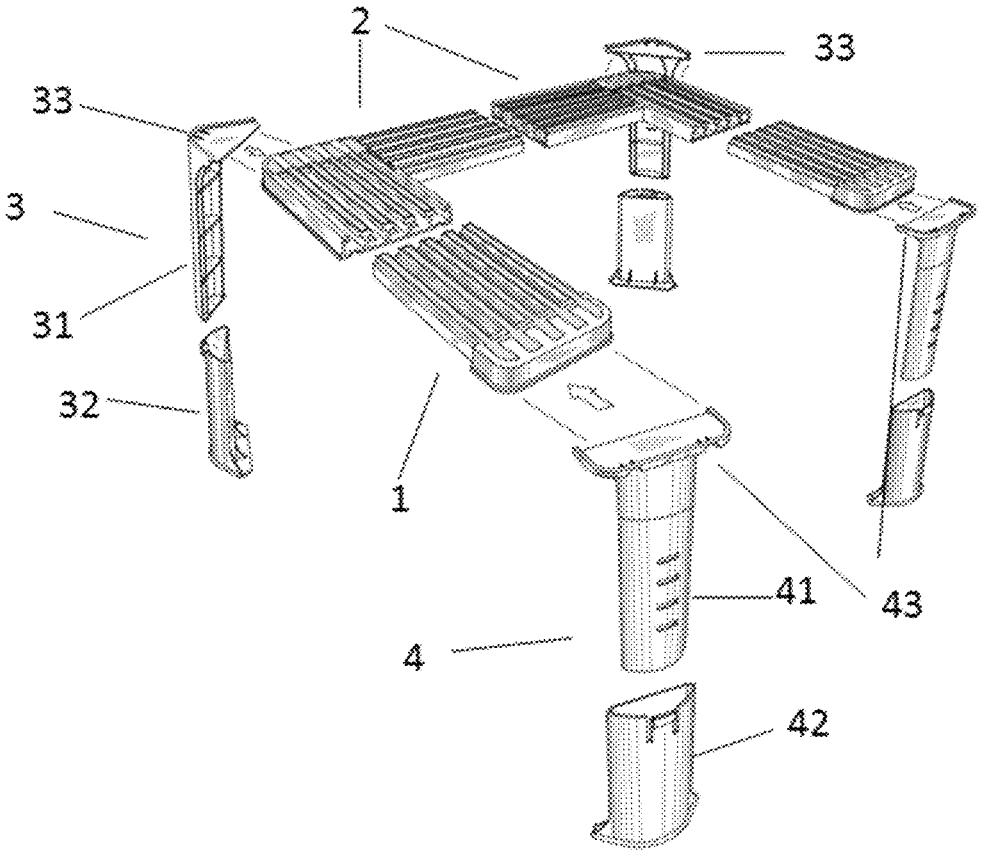
FIG. 2 is an exploded schematic view of a sink shelf organizer provided by an embodiment of the present application.
Figure 3:
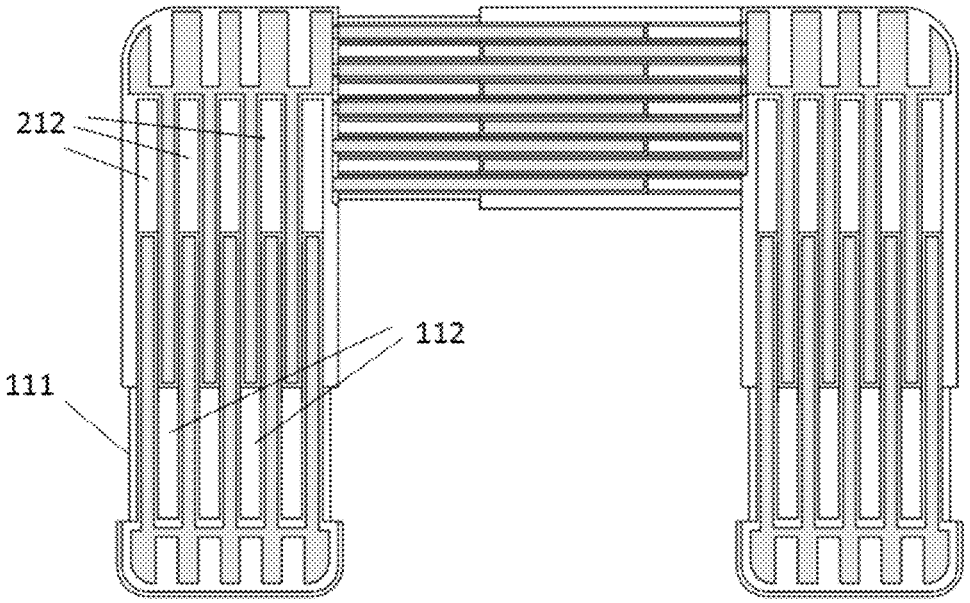
FIG. 3 is a top view of a sink shelf organizer provided by an embodiment of the present application.
Figure 4:
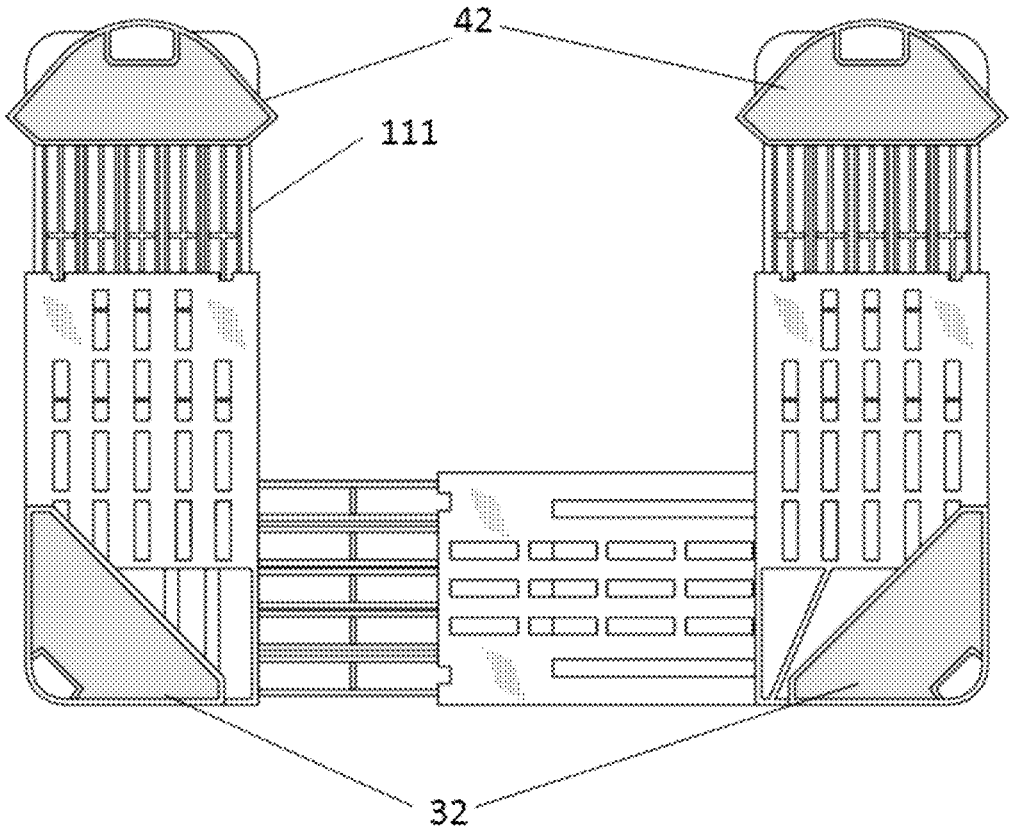
FIG. 4 is a bottom view of a sink shelf organizer provided by an embodiment of the present application.

Referring to FIGS. 1-4, FIG. 1 shows a schematic structural diagram of a sink shelf organizer provided by an embodiment of the present application, FIG. 2 is an exploded schematic view of a sink shelf organizer provided by an embodiment of the present application, FIG. 3 is a top view of the sink shelf organizer provided by an embodiment of the present application, and FIG. 4 is a bottom view of the sink shelf organizer provided by an embodiment of the present application. As shown in FIGS. 1-4, the sink shelf organizer comprises two first connecting plates 1, two second connecting plates 2 and four support legs 3, 4. In particular, the first connecting plate 1 has a comb structure 11 with a plurality of comb fingers arranged in parallel with each other. The second connecting plate 2 comprises two comb structures 21, 22 which are fixed together and substantially perpendicular to each other to form a corner 23, as shown in FIG. 2, the first comb structure 21 is used for coupling with the first connecting plate 1 and the second comb structure 22 is used for coupling with the opposing second comb structure 22 of the other second connecting plate 2 so as to connect these two second connecting plates 2. The two first connecting plates 1 and two second connecting plates 2 can be coupled together to form a telescopic U-shaped frame in the same plane, and this U-shaped frame has one bottom line, two corners 23 and two extendable arms, wherein the bottom line and the two extendable arms all have telescopic structures. The two second connecting plates 2 can move relative to each other to adjust the length of the sink shelf organizer. The length of the extendable arm can be adjusted, for example, by moving the first connecting plate 1 back and forth, so as to adjust the width of the sink shelf organizer. In particular, the first comb structure 21 of the second connecting plate 2 is inactive, and the comb structure 11 of the first connecting plate 1 is active, which can couple with the first comb structure of the second connecting plate 2 and move forward and backward along the longitudinal axis of the extendable arm.

Referring to FIG. 2, two rear support legs are detachably connected to both free ends 12 (i.e. the comb bone side of the first connecting plate 1) of the U-shaped frame respectively, and two front support legs 3 are detachably connected to the two corners 23 of the U-shaped frame (i.e. the corners of the second connecting plates 2) respectively. The front and rear support legs 3, 4 all have adjustable heights. The shelf organizer can be used to place items, pots, and other kitchen utensils, particularly allow the pipes to vertically pass through, and has an adjustable size to adapt to different size spaces under the sink, thereby meeting the needs of different spaces and improving the user experience. The bottom line (formed by the connection of the two second comb structure 22) of the U-shaped frame will be arranged outside when the sink shelf organizer is in use, so that the water pipes can pass through the space surrounded by the U-shaped frame.

The first connecting plate 1 is a rectangular panel with an array of comb fingers (shown as shaded portions in the first connecting plate 1 shown in FIG. 3) arranged thereon. The two first connecting plates 1 are placed in parallel with each other and both perpendicular to the bottom line of the U-shaped frame, accordingly the U-shaped frame of the sink shelf organizer will surround the water pipes and garbage disposal devices under a sink.

In particular, both the first comb structure 21 and the second comb structure 22 of the second connecting plate 2 comprise a plurality of comb fingers (shown as shaded portions in the second connecting plate 2 shown in FIG. 3) arranged in parallel with each other along the length direction of corresponding comb structure. Each comb finger of the first comb structure 21 can be inserted between two neighboring comb fingers of the opposing comb structure 22 to form a telescopic structure. Referring to FIG. 3, the numbers of comb fingers on the comb structure 11 of the first connecting plate 1 is 5, and that on the first comb structure 21 of the second connecting plate 2 is 4. As shown in FIG. 3, the second comb structure 22 on the left second connecting plate 2 is inactive, and the second comb structure 22 of the right second connecting plate 2 is active, that is to say, the comb fingers of the right second connecting plate 2 can be inserted into the spaces among the comb fingers of the left second connecting plate 2 to form a telescopic structure. In other embodiment, the second comb structure 22 on the left second connecting plate 2 may be active, and the second comb structure 22 on the right second connecting plate 2 may be inactive.

In particular, referring to FIG. 4, the second connecting plate 2 further comprises one or two bottom frames 211, wherein each bottom frame 211 has a roughly rectangular shape and is arrange on the back of the second connecting plate 2. A plurality of closely adjacent rectangular gaps 2111 are arranged on the bottom frame 211, the distance between adjacent rectangular gaps along the length direction of the first comb structure 21 is smaller than the distance between adjacent rectangular gaps along the width direction of the first comb structure 21. Spaces such as kitchen and bathroom are generally humid, setting gaps can bring more functions to the shelf organizer, such as placing freshly washed pots on the shelf organizer and draining them, instead of waiting until the pots are completely dry before putting them on the shelf organizer, and the setting of the gap does not affect the basic storage function of the shelf organizer, when the shelf organizer is used to place items, pots, and other kitchen utensils, even the small-sized seasoning bottles can be easily stored because of the small gap.

Referring to FIG. 3, since the first connecting plate 1 comprises the bottom frame 111, a sliding groove 112 is formed between two neighboring comb fingers of the first comb structure 21 of the second connecting plate 2 along the length direction, and the comb finger of the comb structure of the first connecting plate 1 is accommodated in the sliding groove 212 of the second connecting plate 2 and can be moved along the sliding groove 212. In one embodiment, as shown in FIG. 2, the front support leg 3 has a support seat 33 on the top, which has a triangle plate that can be inserted into the groove under the corner of the U-shaped frame. The rear support leg 4 has a support seat 43 of rectangle for coupling with the first connecting plate 1 at the comb bone end, and the support seat connects with the first connecting plate 1 by sliding grooves.

Preferably, in another embodiment, the two corners of the U-shaped frame are rounded. The rounded design can prevent accidental scratches and bruises, which is more safer than the right angle design, more ergonomic, visually more aesthetic, and brings a better user experience.

Referring to FIGS. 5-8, the front, rear, left, and right views of the sink shelf organizer provided by the embodiment of the present application are shown in the figures, the front and rear support legs 3, 4 each has a generally square tubular structure and comprises a support column 31, 41 and a base 32, 42, the diameter of the support column 31, 41 is slightly smaller than the diameter of the base 32, 42 so that the support column 31,41 can be inserted into the base 32, 42 and by adjusting the height of the support column 31 inserted into the base 32 in a clamping manner, the height of the support leg is adjustable, one end of the support column 41 is detachably connected to the first connecting plate 1, and the other end of the support column 41 is connected to one end of the base 42, the other end of the base 42 is grounded, so that there are two rear support legs 4 arranged on both ends of the first connecting plate 1 and detachably connected thereto.

The one end of the support column 31 connected to the base 32 is provided with the first clamping portion 311, and the opposing end of the base 32 is provided with the second clamping portion 321, the first clamping portion 311 and the second clamping portion 321 are clamped to limit positions, which is convenient to install and remove, and the height of the support column 31 inserted into the base 32 can be adjusted at any time to adjust the height of the support leg to adapt to sinks and cleaning appliances of various sizes, on the basis that the shelf organizer can be stretched left and right, and back and forth, the utilization of the space under the sink is further improved, and the user experience is improved. There are many ways to engage the first clamping portion 311 and the second clamping portion 321. For example, the first clamping portion 311 may be a slot, and the second clamping portion 321 may be a protruding piece, wherein the slot can be mated with the protruding piece.

Figure 5:
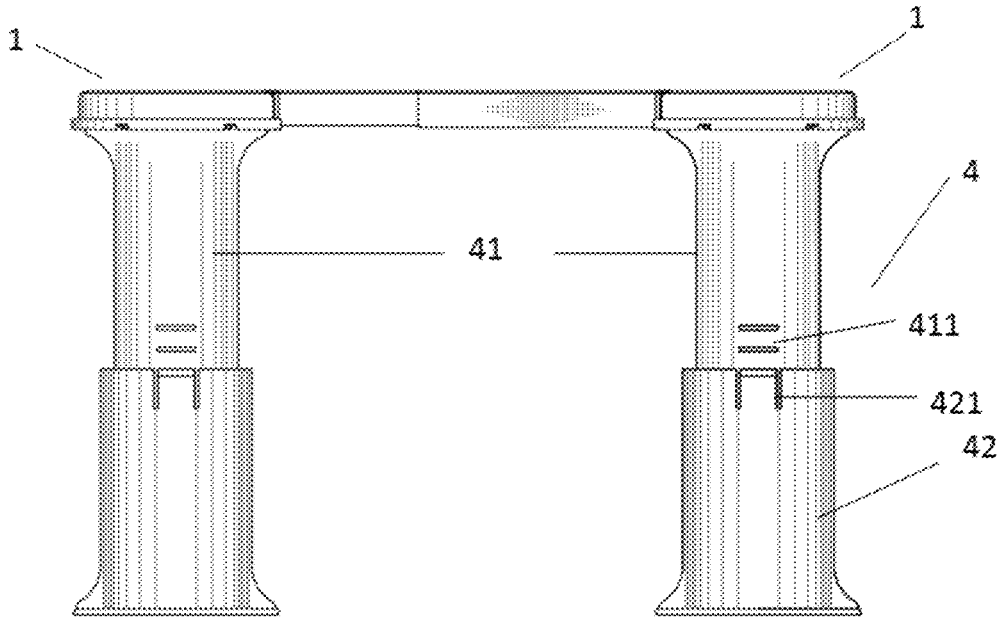
FIG. 5 is a front view of a sink shelf organizer provided by an embodiment of the present application.
Figure 6:
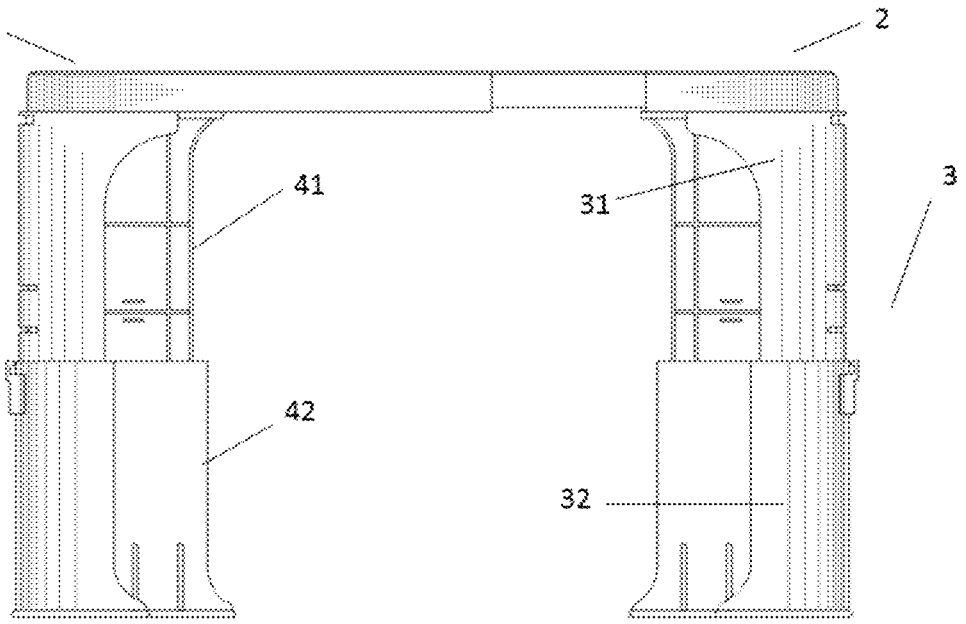
FIG. 6 is a rear view of a sink shelf organizer provided by an embodiment of the present application.
Figure 7:
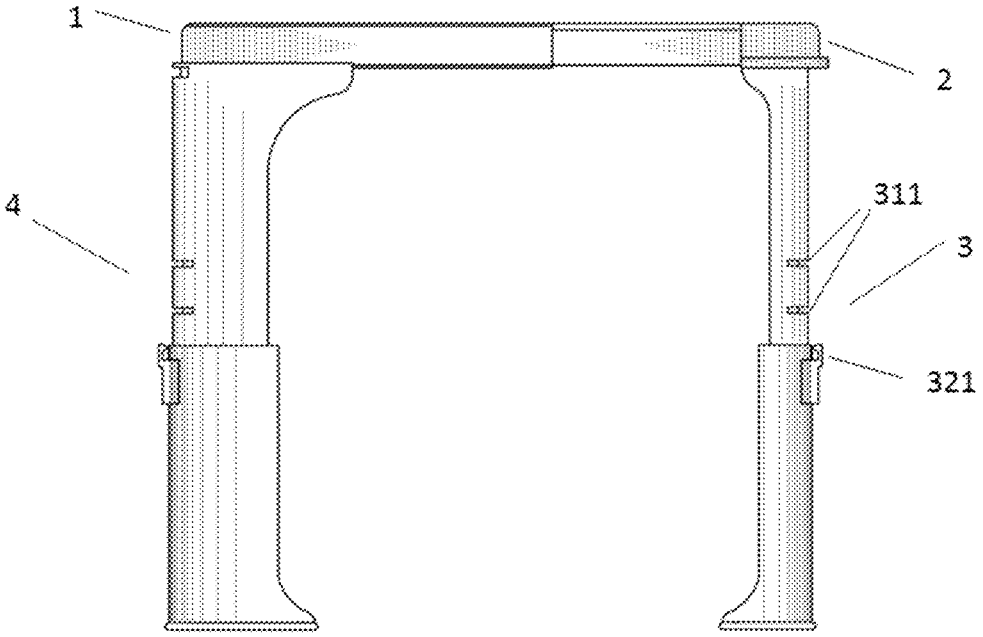
FIG. 7 is a left view of a sink shelf organizer provided by an embodiment of the present application.
Figure 8:
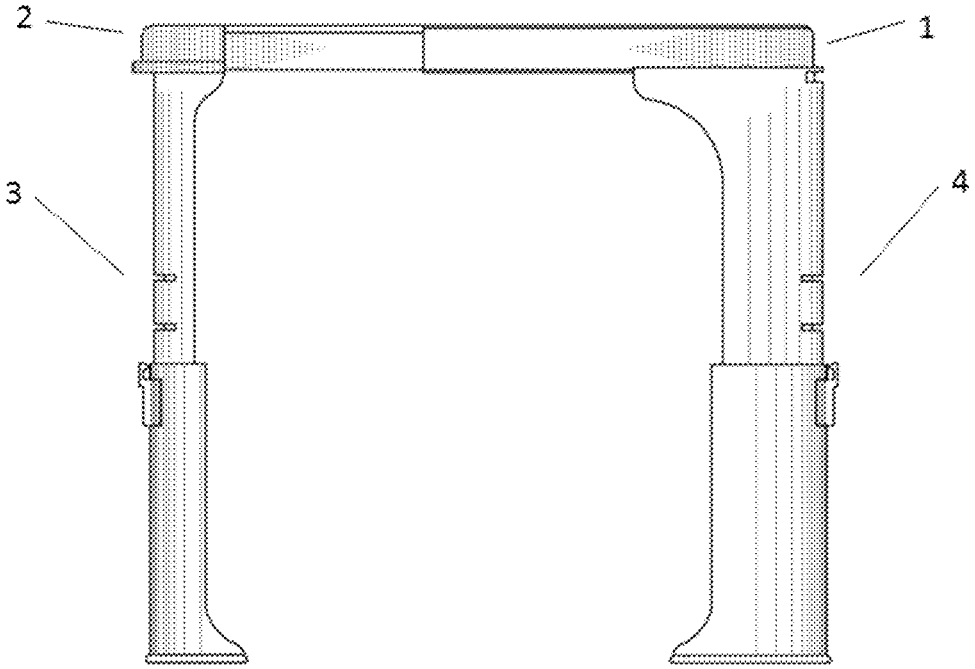
FIG. 8 is a right view of a sink shelf organizer provided by an embodiment of the present application.

As shown in FIG. 5, the grounded end of the base 42 has been processed into a design with an "inverted T" cross-section, which has a better anti-slip effect than ordinary square pipe, and can strengthen the mechanical design of the shelf organizer to bear more weight. In a specific embodiment, the shelf organizer can bear 15 KG and can be filled with various kitchen utensils, cleaning utensils and other sundries.

In other embodiments, the support legs 3, 4 may also have a flat cross section with a hollow structure. Preferably, the front support leg has smaller width than the rear support leg, this structure is convenient for putting in or taking out items under the U-shaped frame of the shelf organizer, and the side closing to the wall of the washroom will be more stable.

Preferably, the rear support leg 4 is configured to detachably connect to the first connecting plate 1 (free end of the U-shaped frame) by detachably connecting to the free end of the U-shaped frame, and the front support leg 3 is configured to detachably connect to the second connecting plate 2 by detachably connecting to the corner of the U-shaped frame.

Alternatively, the second connecting plate 2 and the first connecting plate 1 may be made by an integral molding process and are fixedly connected. The fixed connection between the second connecting plate 2 and the first connecting plate 1 can make the installation of the shelf organizer more convenient, and the shelf organizer can withstand greater pressure.

Preferably, the second connecting plate 2 and the first connecting plate 1 are separated with each other before the assembly of the shelf organizer. The detachable connection between the second connecting plate 2 and the first connecting plate 1 makes the disassembly of the shelf organizer more convenient, the first connecting plate 1 and the second connecting plate 2 can be separated and placed, which saves more storage space.

The working principle of the present application is as follows:

when the shelf organizer needs to be extended, stretch the first connecting plate 1, or the second connecting plate 2 with the active comb structure, or adjust the height of the support leg 3, or simultaneously stretch the first connecting plate 1 and the second connecting plate 2 with the active comb structure and adjust the height of the support leg 3, so that the size of the shelf organizer is suitable for the space under the sink and the size of kitchenware, cleaning appliances, etc., and meets the need to maximize space utilization.

Considering the space under the sink is so limited, and there are only three lines in the U-shaped frame, so that there is more open space provided by the present sink shelf organizer, and the shelf organizer has an adjustable size which is convenient for storage. There is no screw needed in the present sink shelf organizer. All the components of the sink shelf organizer are connected or coupled by clamping structures.

The sink shelf organizer provided by the embodiment of the present application is simple in structure and convenient to use. The detachable connection method is convenient for installation and the shelf organizer can be assembled without screws or other tools; when not in use, it can be disassembled and placed, occupying less space. In addition, the shelf organizer has the advantages of simple design and beautiful appearance.

The sink shelf organizer provided by the embodiment of the present application is made of PP material, and is non-slip and waterproof. In addition, besides being used under the sink, the shelf organizer can also be placed next to the bathroom sink to store various cleaning utensils, so that the items can be arranged more neatly and the use frequency of the items can be increased. Of course, the shelf organizer can also have many other storage functions according to user needs, with a wide range of applications and high user experience.

The sink shelf organizer provided by the embodiment of the present application is supported by the ground, and is not suspended on a pole, a round pipe or a faucet. This floor-type shelf organizer provides two layers of storage space, and some items can be placed in the first connecting plate and the second connecting plate, some items can be directly placed on the ground, making full use of the space in the air and the ground. The U-shaped structure is used to allow the water pipes and garbage processors under the sink to pass through; in addition, the U-shaped design can make the items arrange more neatly, any utensils and the corresponding positions of the utensils are clear and convenient for users to find the required items faster, and the U-shaped design improve the use efficiency of the items.

The embodiments of the present application have been described in detail above, specific embodiments are used in this document to explain the principles and implementation of the present application, the descriptions of the above embodiments are only used to help understand the method and core ideas of the present application; at the same time, persons of ordinary skill in the art may change the specific implementation and application scope according to the idea of the present application, in summary, the content of the present description should not be construed as a limitation on the present application.

The reference marks in the drawings are as follows: 1—first connecting plate; 2—two second connecting plate; 11, 21, 22—comb structure; 23—corner; 12—free end; 3—front support leg; 4—rear support leg; 111, 211—bottom frame; 112, 212—sliding groove; 33, 43—support seat; 31, 41—support column; 32, 42—base; 311, 411—first clamping portion; 321, 421—second clamping portion.

What is claimed is:

1. A sink shelf organizer comprising two first connecting plates, two second connecting plates and two front support legs and two rear support legs, wherein the first connecting plates each comprises one comb structure, the second connecting plates each comprises a first comb structure for coupling with each first connecting plate and a second comb structure for coupling with the opposing second connecting plate, the first and second comb structures of each second connecting plate fixed together and substantially perpendicular to each other, the two first connecting plates and two second connecting plates are coupled together to form a telescopic U-shaped frame with two corners and two free ends, the two front support legs are detachably connected to the two corners of the U-shaped frame respectively and the two rear support legs are detachably connected to the two free ends of the U-shaped frame respectively.

2. The sink shelf organizer of claim 1, wherein the front and rear support legs each has an adjustable height.

3. The sink shelf organizer of claim 1, wherein the two free ends are formed by the two first connecting plates which are extendable along the length direction thereof so that the shelf organizer is capable of being stretched back and forth.

4. The sink shelf organizer of claim 1, wherein the two second connecting plates are movable relative to each other, one second connecting plate comprises an inactive second comb structure, and the other second connecting plate comprises an active second comb structure to couple with the inactive second comb structure.

5. The sink shelf organizer of claim 1, wherein the one comb structure of each first connecting plate and the first and second comb structures of each second connecting plate each comprises an array of comb fingers which are arranged in parallel with each other.

6. The sink shelf organizer of claim 5, wherein the first comb structure of each second connecting plate comprises an array of sliding grooves for accommodating the array of comb fingers of a respective one of the first connecting plates.

7. The sink shelf organizer of claim 1, wherein each second connecting plate further comprises a rectangular bottom frame arranged on the bottom of the first comb structure, and a plurality of rectangular gaps are arranged on the bottom frame, the distance between adjacent rectangular gaps along the length direction of the first comb structure is smaller than the distance between adjacent rectangular gaps along the width direction of the first comb structure.

8. The sink shelf organizer of claim 1, wherein each support leg comprises a support column and a base, the diameter of the support column is smaller than the diameter of the base so that the support column is insertable into the base, and by adjusting the height of the support column inserted into the base in a clamping manner, the height of the support leg is adjustable, one end of the support column is connected to the first connecting plate or the second connecting plate, and the other end of the support column is connected to one end of the base, the other end of the base is grounded.

9. The sink shelf organizer of claim 1, wherein each front support leg has a smaller width than that of each rear support leg.

10. The sink shelf organizer of claim 8, wherein the one end of the support column connected to the base is provided with a first clamping portion, and the one end of the base connected with the support column is provided with a second clamping portion, the first clamping portion and the second clamping portion are clamped to limit positions respectively.

11. The sink shelf organizer of claim 8, wherein the grounded end of the base has an "inverted T" cross-section.

12. The sink shelf organizer of claim 1, wherein the sink shelf organizer is made of polypropylene material.

* * * * *